US010016050B2

(12) United States Patent
Dent

(10) Patent No.: US 10,016,050 B2
(45) Date of Patent: Jul. 10, 2018

(54) HOLSTER STRAP

(71) Applicant: Michael Curtis Dent, Smithfield, UT (US)

(72) Inventor: Michael Curtis Dent, Smithfield, UT (US)

( * ) Notice: Subject to any disclaimer, the term of this patent is extended or adjusted under 35 U.S.C. 154(b) by 62 days.

(21) Appl. No.: 14/791,243

(22) Filed: Jul. 2, 2015

(65) Prior Publication Data

US 2017/0000246 A1 Jan. 5, 2017

(51) Int. Cl.

| | |
|---|---|
| ***A45F 5/00*** | (2006.01) |
| ***A45F 5/02*** | (2006.01) |
| *A45C 13/30* | (2006.01) |

(52) U.S. Cl.

CPC ..... *A45F 5/021* (2013.01); *A45C 2013/306* (2013.01); *A45F 2005/002* (2013.01); *A45F 2005/006* (2013.01); *A45F 2200/0533* (2013.01); *A45F 2200/0591* (2013.01)

(58) Field of Classification Search

CPC ..... A45F 5/021; A45F 2005/002; A45F 2005/006; A45F 2200/0533; A45F 2200/0591; A45C 2013/306

USPC ..... 224/269

See application file for complete search history.

(56) References Cited

U.S. PATENT DOCUMENTS

| | | | | |
|---|---|---|---|---|
| 2,869,198 | A * | 1/1959 | Clevett, Jr. | A45F 5/021 24/3.12 |
| 4,923,105 | A * | 5/1990 | Snyder | A45F 3/14 224/232 |
| 5,511,706 | A * | 4/1996 | Hendrickson | A45F 5/02 224/268 |
| 5,722,576 | A * | 3/1998 | Rogers | A45F 5/02 224/195 |
| 5,729,869 | A | 3/1998 | Anscher | |
| 5,954,253 | A | 9/1999 | Swetish | |
| 6,279,362 | B1 * | 8/2001 | Lee | A44B 15/00 70/456 R |
| 6,390,348 | B1 * | 5/2002 | Godshaw | A45F 5/00 224/660 |
| 7,007,352 | B1 * | 3/2006 | Hill | A45F 5/02 24/3.1 |
| 7,331,872 | B1 * | 2/2008 | Parsons | A45F 5/02 224/195 |
| 9,326,586 | B2 * | 5/2016 | Kax | A45F 3/04 |
| 9,451,821 | B1 * | 9/2016 | Estigoy | A45F 5/021 |
| 2004/0221429 | A1 | 11/2004 | Falany | |
| 2006/0213944 | A1 | 9/2006 | Dieter | |
| 2007/0145091 | A1 | 6/2007 | Meesey | |
| 2007/0158380 | A1 | 7/2007 | Calkin | |
| 2011/0278338 | A1 | 11/2011 | Darnell, II et al. | |
| 2012/0217274 | A1 | 8/2012 | Cipes | |

(Continued)

*Primary Examiner* — Derek Battisti

(57) ABSTRACT

A holster strap that allows for the attachment of a variety of holster types (thread-on, clip-on, paddle, as well as left and right holsters) to a backpack waist belt. The holster strap allows quick access and removal of a holster and includes a base and a strap. The base may be secured to the backpack waist belt and the strap secures the holster to the base. The strap may be stretchable and durable such that it may hold various size holsters with a heavy firearm, camera, or another item. The holster strap allows a holster to be quickly removed from a backpack waist belt and transferred to a belt when the backpack is removed.

10 Claims, 9 Drawing Sheets

(56) References Cited

U.S. PATENT DOCUMENTS

2013/0047386 A1* 2/2013 Barfoot ..... A47F 5/0006
24/580.1

* cited by examiner

HOLSTER STRAP

TECHNICAL FIELD

The present disclosure relates to outdoor recreation gear, and more specifically, a device and method for securing a holster to the waist belt of a backpack.

BACKGROUND

An individual backpacking in the wilderness may wish to carry a holster on the hip or around the waist in a comfortable and accessible manner. A holster may be used to carry a firearm, a camera, or other device. There does not presently exist a device that allows an individual wearing a camping or framed backpack with a padded waist belt to also carry a holster on the hip or around the waist without interfering with the backpack waist belt.

SUMMARY

The present disclosure in aspects and embodiments addresses these various needs and problems by providing a holster strap that connects a holster to the waist belt of a camping or framed backpack. The holster strap allows a backpacker to carry a holster with a firearm or camera in a comfortable and accessible manner.

DETAILED DESCRIPTION

Figure 1:
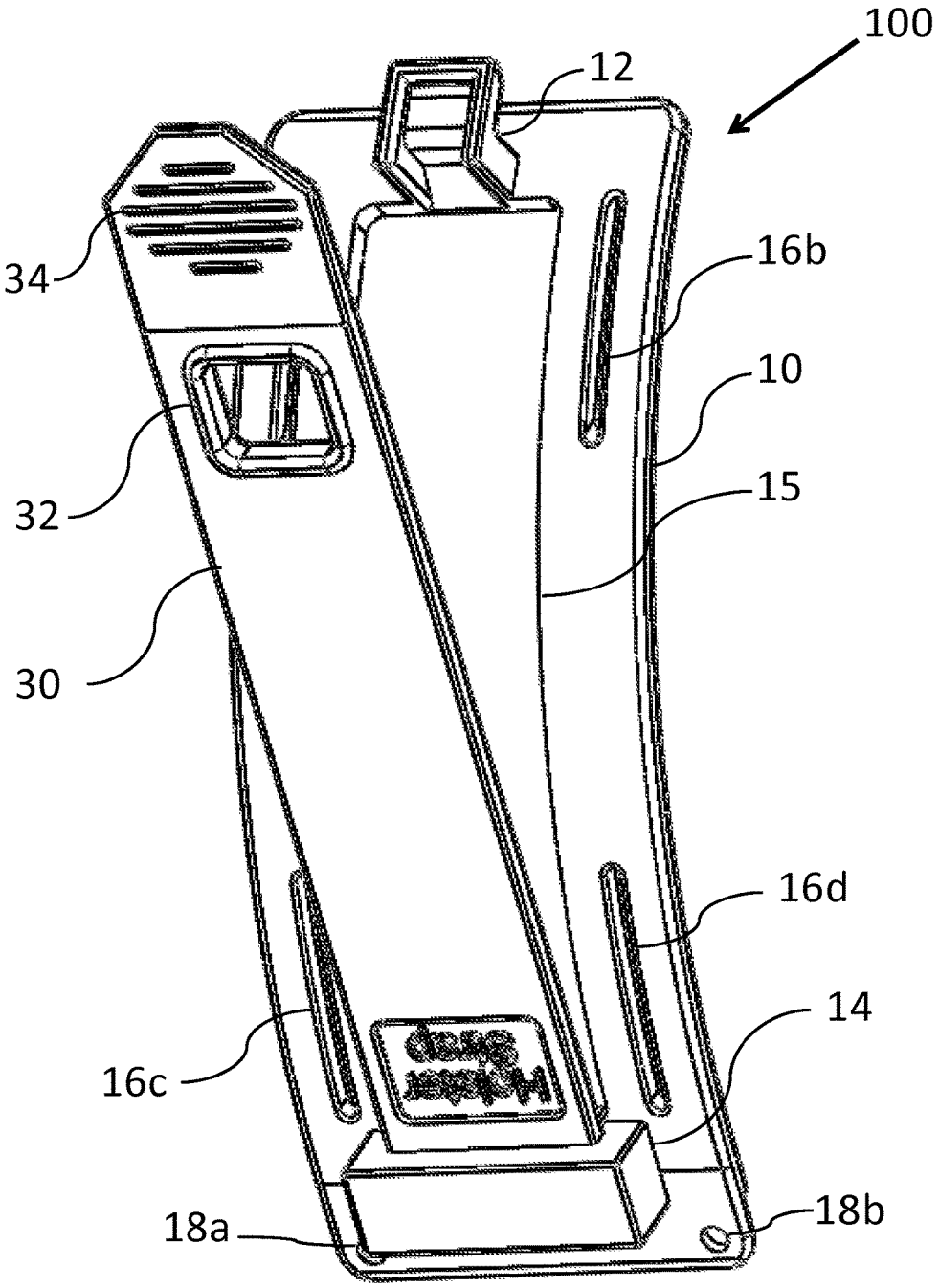
FIG. 1 illustrates a front-side view of an embodiment of a holster strap 100.

The present disclosure covers apparatuses and associated methods for securing a holster to the waist belt of a camping or framed backpack. In the following description, numerous specific details are provided for a thorough understanding of specific preferred embodiments. However, those skilled in the art will recognize that embodiments can be practiced without one or more of the specific details, or with other methods, components, materials, etc. In some cases, well-known structures, materials, or operations are not shown or described in detail in order to avoid obscuring aspects of the preferred embodiments. Furthermore, the described features, structures, or characteristics may be combined in any suitable manner in a variety of alternative embodiments. Thus, the following more detailed description of the embodiments of the present invention, as illustrated in some aspects in the drawings, is not intended to limit the scope of the invention, but is merely representative of the various embodiments of the invention.

In this specification and the claims that follow, singular forms such as "a," "an," and "the" include plural forms unless the content clearly dictates otherwise. All ranges disclosed herein include, unless specifically indicated, all endpoints and intermediate values. In addition, "optional", "optionally", or "or" refer, for example, to instances in which subsequently described circumstance may or may not occur, and include instances in which the circumstance occurs and instances in which the circumstance does not occur. The terms "one or more" and "at least one" refer, for example, to instances in which one of the subsequently described circumstances occurs, and to instances in which more than one of the subsequently described circumstances occurs.

The following examples are illustrative only and are not intended to limit the disclosure in any way.

EXAMPLES

Figure 2:
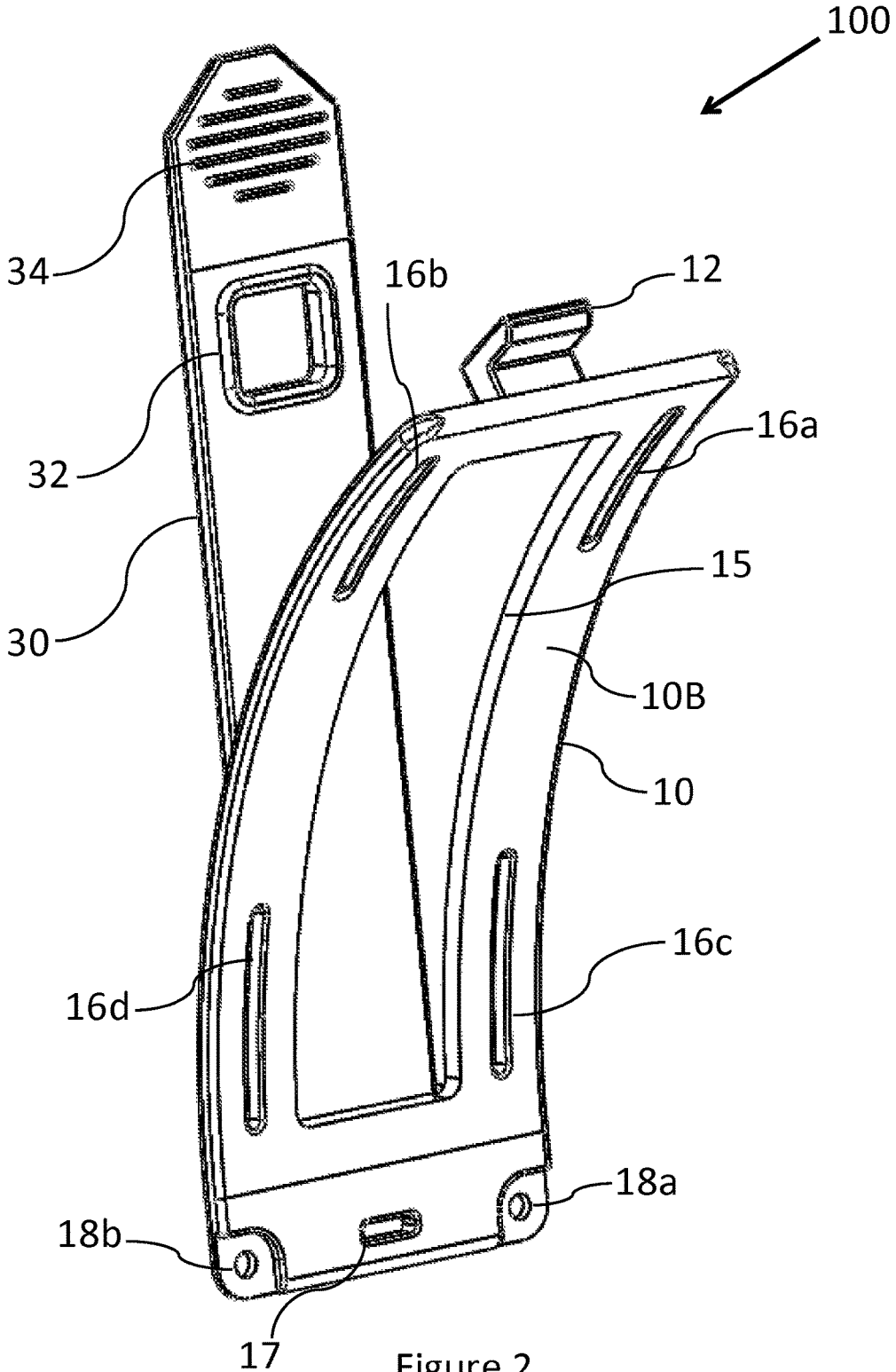
FIG. 2 illustrates a back-side view of the holster strap shown in FIG. 1.

FIGS. 1 and 2 illustrate an embodiment of a holster strap 100. A holster strap 100 has a base 10 and a flexible strap 30 secured to the base 10. A base 10, illustrated in FIGS. 3A and 3B (both front-side views), has a strap fastener 14 at one end (a proximal end), and a base clip 12 at another end (a distal end). The flexible strap 30, illustrated in FIG. 4, has a strap retainer 36 and a strap eyelet 32. The base strap fastener 14 is configured to secure the strap retainer 36 to the base 10 at the proximal end of the base. The flexible strap 30, while secured at the base 10 proximal end, is configured to stretch such that the eyelet 32 may be secured to the base clip 12 at the distal end. The base strap fastener 14 may have a sleeve or slot 14A such that the flexible strap 30 may be threaded through the sleeve or slot 14A and be secured to the base strap fastener 14.

In embodiments, the base strap fastener 14 and the base clip 12 may be injection molded or 3D manufactured directly onto the base 10 and thus be made of the same material as the base 10. In alternative embodiments, the base strap fastener 14 or base clip 12 may be glued, bolted, or riveted to the base 10. In preferred embodiments, the base strap faster 14 has a sleeve or slot 14A which allows the flexible strap 30 to be easily replaced without tools if it becomes worn or broken.

Figure 3A:
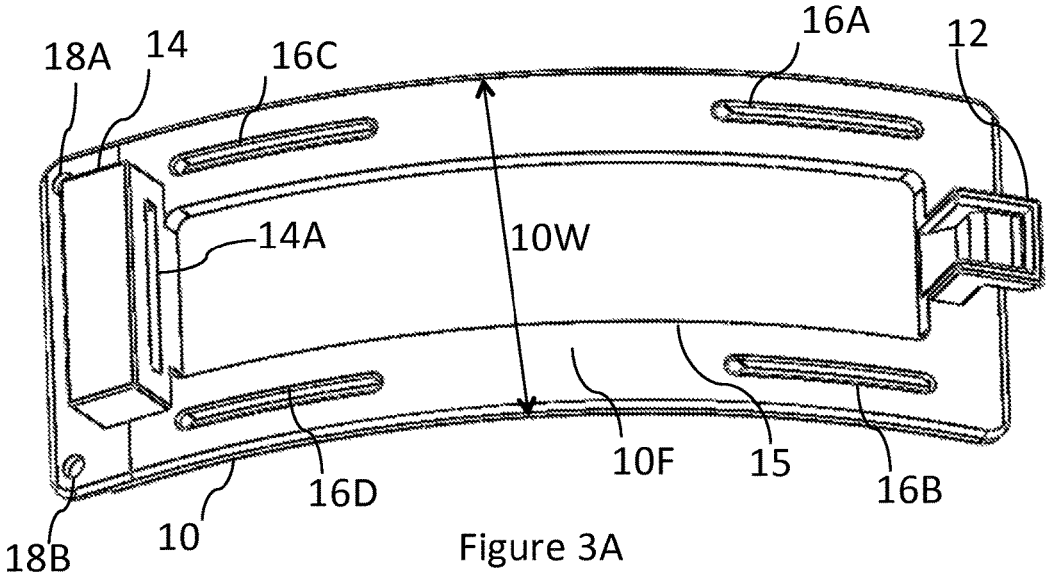
FIG. 3A illustrates a base of the holster strap shown in FIGS. 1 and 2.
Figure 6:
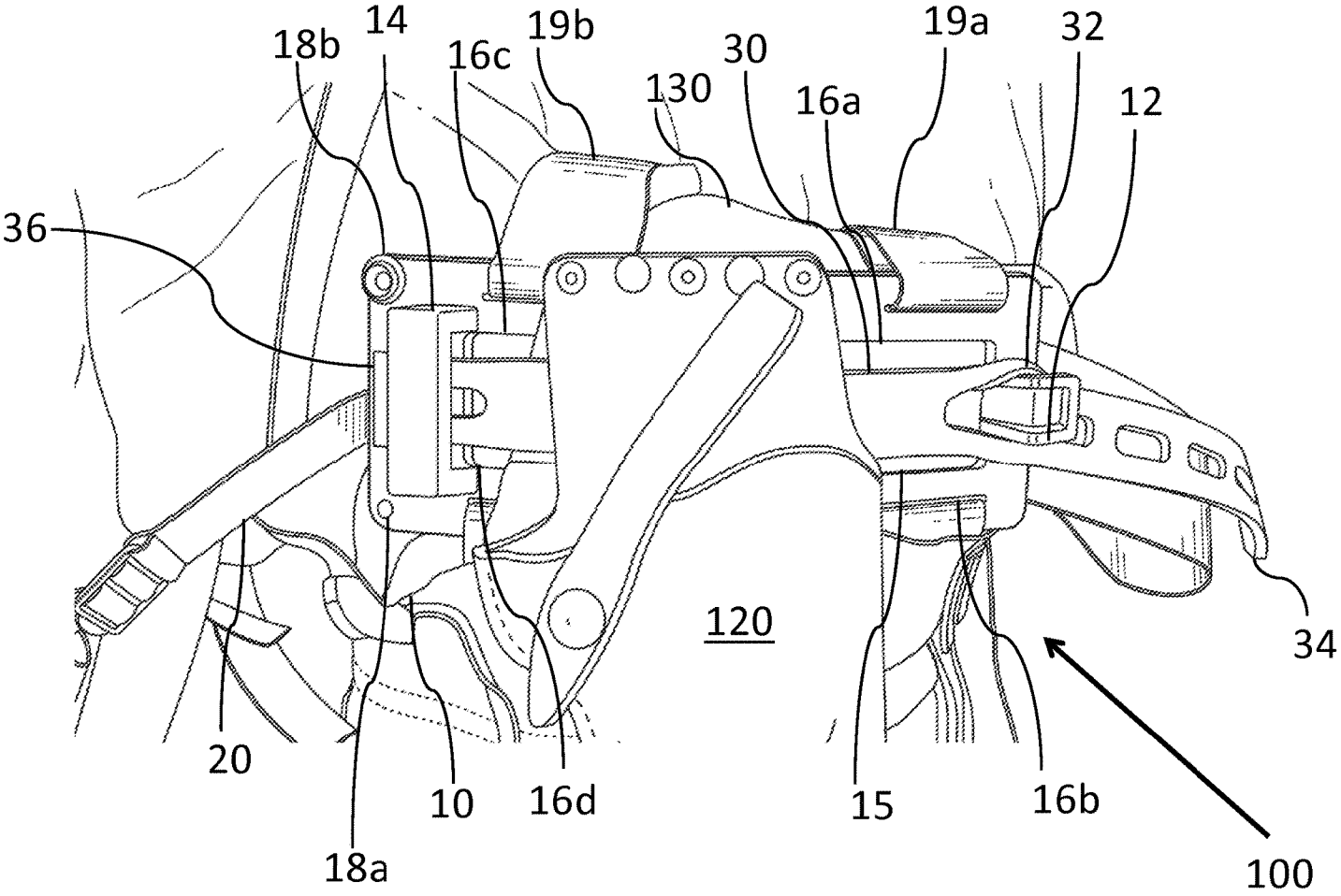
FIG. 6 illustrates the holster strap 100 shown in FIGS. 1 and 2 secured to the waist belt of a backpack.
Figure 7:
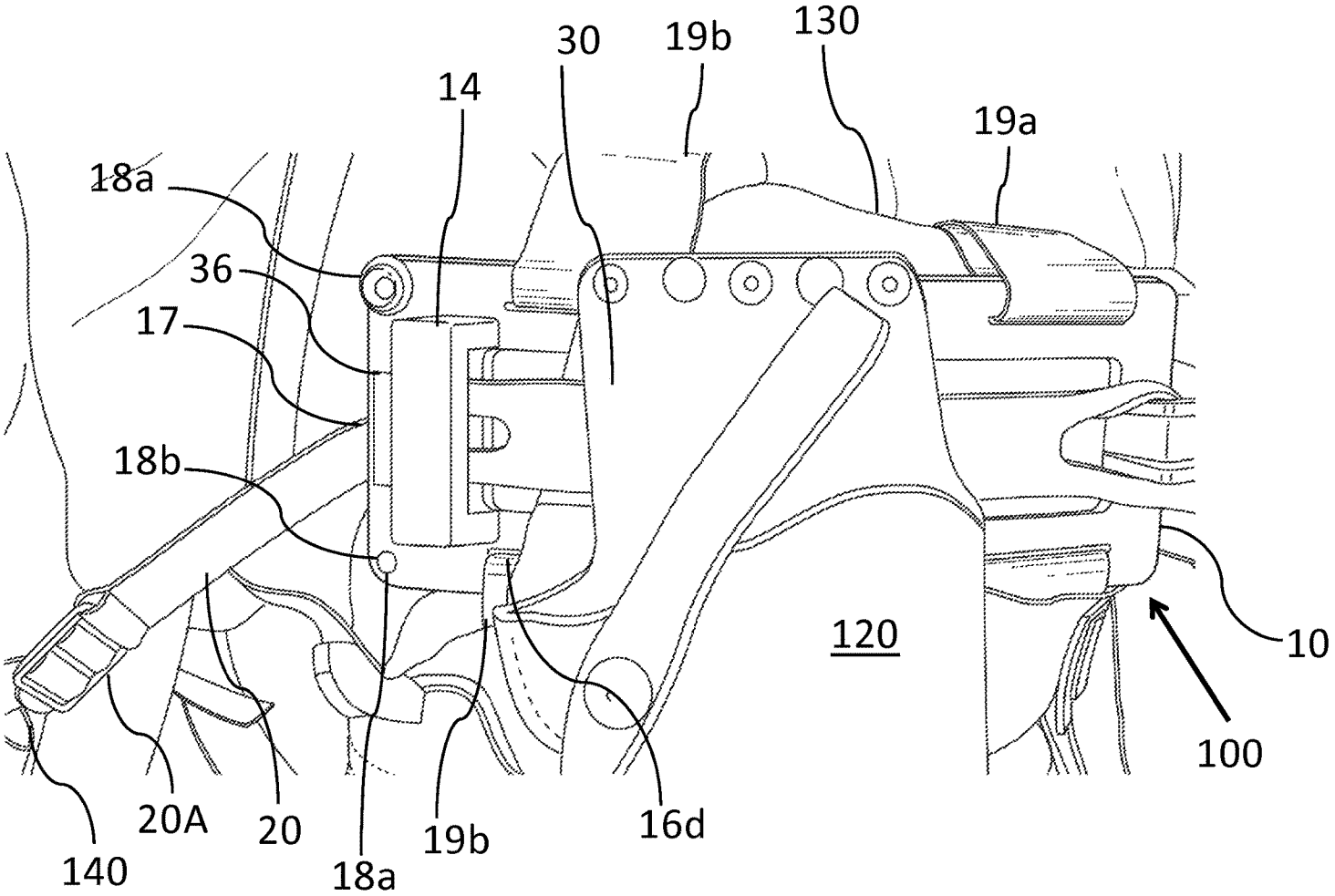
FIG. 7 illustrates another view of the holster strap 100 illustrated in FIGS. 1 and 2 secured to the waist belt of a backpack.

Referring also to FIG. 3A, the base 10 may have one or more base fastener notches 16A-D and one or more base retaining straps 19A-B (shown in FIGS. 6 and 7). The base retaining straps 19A-B may be configured to weave through the one or more base fastener notches 16A-B and secure the base 10 to a padded backpack waist belt 130 (shown in FIGS. 6 and 7). The base retaining straps 19A-B may be made from nylon webbing or Velcro® straps. Depending on how the holster strap 10 is secured to a backpack waist belt, there may be more than two base retaining straps 19A-B.

Figure 3B:
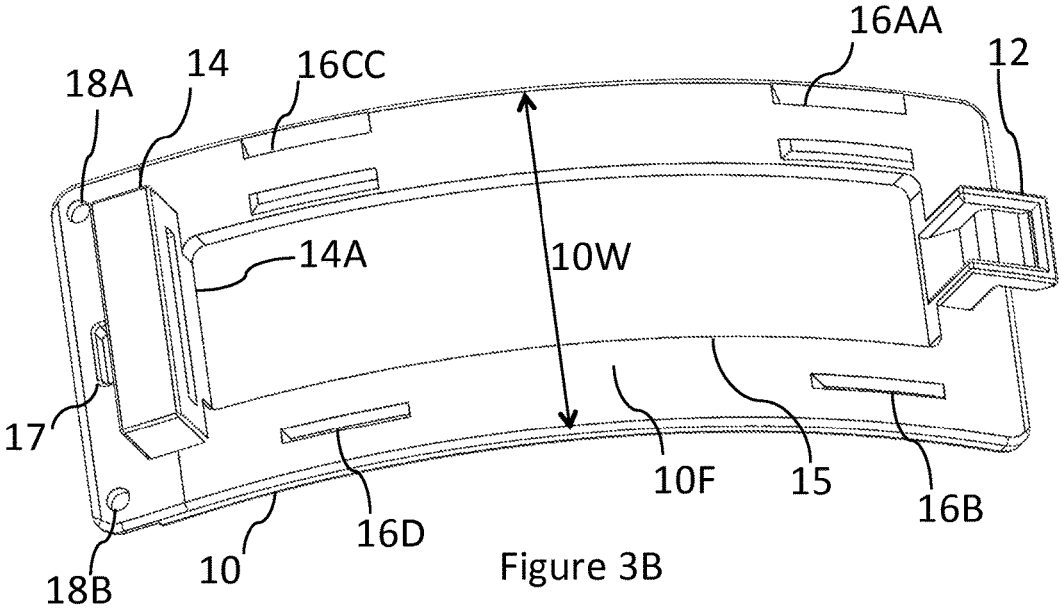
FIG. 3B illustrates a base of another holster strap with other base fastener notches.

Referring to FIG. 3B, in embodiments, ladder locks or double-bar buckles 16CC and 16AA may be built or formed into base 10 to secure retaining straps 19A-B. In embodiments a loop (not shown) may be sewn in retaining straps 19A-B with a portion of each loop threaded through slots 16D and 16B and around a bottom portion of base 10. The retaining straps 19A-B may then be threaded around the back of a backpack waist belt 130 (e.g., between the waist belt and the wearer as shown in FIGS. 6 and 7) and up through ladder locks or double-bar buckles 16CC and 16AA to secure base 10 to a backpack waist belt 130.

In embodiments, the retaining straps 19A-B are sized such that they can accommodate a variety of backpack waist belt sizes (diameters) and therefore allow use of the holster strap 100 with most backpacks. Retaining straps 19A-B may also be sized to have sufficient strength to hold the holster strap 100 and a holster (e.g., holster 120 shown in FIGS. 6 and 7) carrying a heavy item, such as a firearm or camera, while in use without causing discomfort to the user. The base retaining straps 19A-B may be made from nylon webbing. The retaining straps 19A-B straps may be easily detached to allow the holster strap 100 to be removed off of a backpack waist belt.

The base 10 may include other means of securing retaining straps 19A-B to base 10 other than fastener notches 16A-D. For example, retaining straps 19A-B may be secured with glue, screws, bolts, snaps, or rivets to the base backside 10B. Alternatively, retaining straps 19A-B may be attached to the base front-side 10F in a similar manner.

Figure 5:
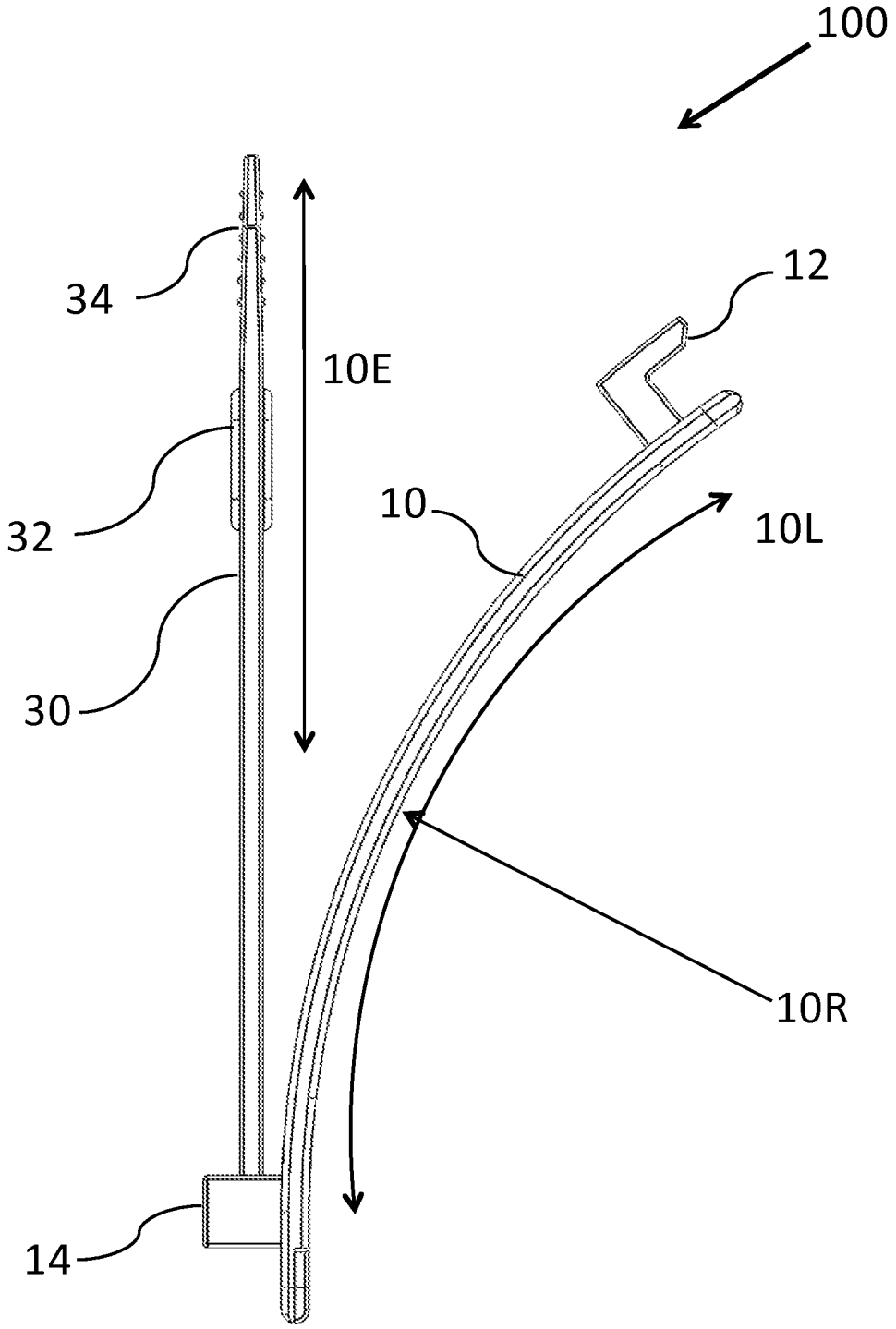
FIG. 5 illustrates a side view of the holster strap shown in FIGS. 1 and 2 and further illustrates the radius of curvature of the base 10 shown in FIG. 3 and the flexible strap 30 shown in FIG. 4.

Referring now to FIGS. 3A, 3B, and 5, the base 10 may be made from a plastic such as polyvinyl chloride (PVC), acrylonitrile butadiene styrene (ABS), nylon, high density polyethylene (HDPE), glass-filled nylon resin, wood, or a low density metal such as aluminum. The base 10 may be injection molded, 3d-printed, or machined. The base 10 has a radius of curvature 10R, as illustrated in FIG. 5. The radius of curvature 10R may match the waist size from between 28 inches and 48 inches, or the waist size of most individuals wearing a backpack with a padded waist belt. Alternatively, the radius of curvature 10R may match a waist size from between 28 and 42 inches, 28 and 40 inches, 28 and 36 inches, 28 and 34 inches, 28 and 32 inches, or any waist size between.

In embodiments, the base 10 is sufficiently rigid to maintain the radius of curvature 10R with the flexible strap 30 under tension and stretched between the strap fastener 14 and base clip 12. A sufficiently rigid base 10 allows a user to comfortably wear the holster strap 100 with the flexible strap 30 under tension and holding a holster containing a firearm or camera. The base 10 is also slightly flexible to match variations in radius of waist sizes between individuals, or the waist sizes described above, when the flexible strap 30 is stretched between the strap fastener 14 and base clip 12.

The base 10 has a length 10L. The base length 10L may be sufficiently long to match the length of one side of a padded backpack waist belt 130. The base length 10L may also be sufficiently long to allow for a small or large holster to fit between the strap fastener 14 and the base clip 12. Likewise, a distance between the strap fastener 14 and base clip 12 may be such that the flexible strap 30 is sufficiently long to thread through various holsters that require a short or long length of belt (or flexible strap 30). For example, the base length 10L may be longer than three inches or shorter than 16 inches, or any length between.

Many padded waist belts of backpacks decrease in width or taper as the belt extends from a wearer's hip to the belly. As such, a holster strap 100 secured to the padded waist belt via base retaining straps 19A-B may have a tendency to slide towards a wearer's belly, especially if the holster is holding a heavy firearm or a large camera. The tendency of the holster strap 100 sliding can make the carrying of a holster with a backpack uncomfortable. For this reason, the base 10 may include a base-retaining notch 17 and a base positioner strap 20. Base position strap 20 may also be made from nylon webbing. One end of the base positioner strap 20 may be secured to the base-retaining notch 17 and the other end of the base positioner strap 20 may be secured to a backpack frame 140, or another portion of the backpack, to radially secure the base 10 proximal the side of the backpack or on the wearer's hip. The positioner strap 20 may be adjustable with a sliding clip or double-bar buckle 20A to match variations in waist sizes between individuals, or the waist sizes described above.

The base 10 may also be symmetrical about its length. The base 10 symmetry allows a user to wear the holster strap 100 on either a left or right side waist. This allows the holster strap to be used with both left and right-hand holsters.

The width 10W of the base 10 may be such that the base 10 may be placed securely on the face of a backpack waist belt 130. The base 10 may be secured to the backpack waist belt such that the base 10 does not rotate to the underside of the waist belt 130 when a holster with a heavy firearm or large camera is attached.

The base 10 may also include base cover holes 18A-B to which snaps (not shown), or another attachment device, may be used to attach a holster cover to the holster strap 100. A holster cover may be snapped to the base 10. Holster covers (large and small) are typically made of water proof fabric and have an elastic fabric strip sewn within the fabric and extending around the perimeter which keeps the cover in place over the holster but also allows for the quick removal of the cover. A holster cover may be easily removed with snaps. The covers can also be used with the holster strap 100 in the left or right-hand position. The covers provide protection of the holster from water and soil as well as concealing the holster from view, e.g., to allow the wearer to conceal a firearm or cover a delicate camera from the elements. The size of a holster cover is such that it will work with most holsters.

Figure 4:
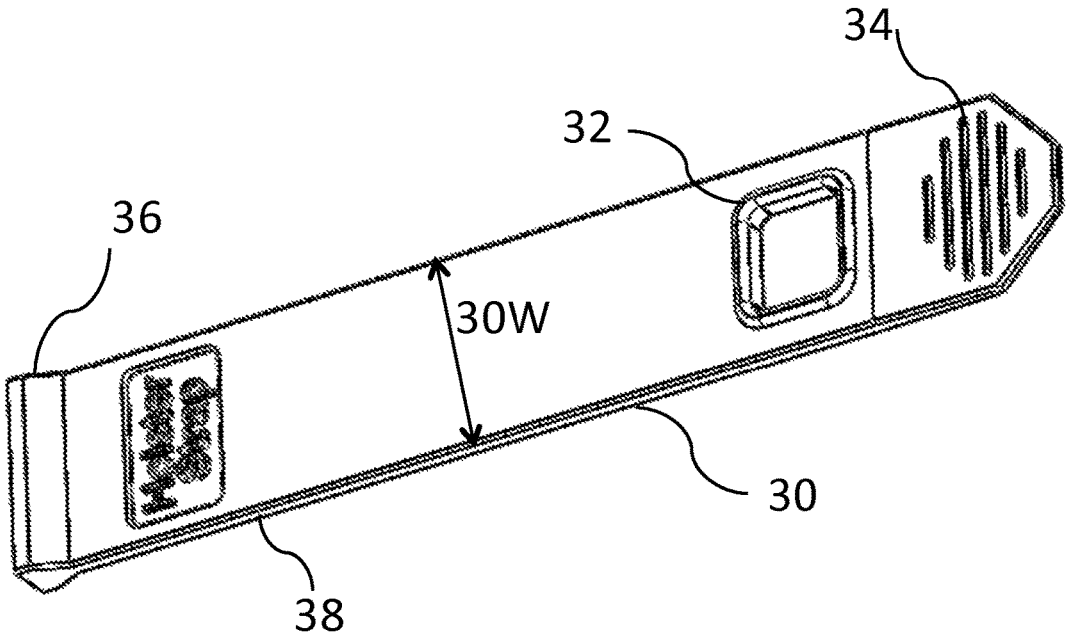
FIG. 4 illustrates the flexible strap 30 of the holster strap 100 shown in FIGS. 1 and 2.

Referring now to FIGS. 1, 2, and 4, the flexible strap 30 includes a strap retainer 36 and one or more strap eyelets 32 formed in the flexible strap 30. In embodiments, the flexible strap 30 is secured to the base 10 as it is threaded through the strap fastener 14, stretched, and hooked via strap eyelet 32 to base clip 12.

The strap retainer 36 may be an enlarged portion of flexible strap 30, which seats into strap fastener 14 and prevents flexible strap 30 from sliding all the way through the strap fastener slot 14A (shown in FIG. 3). In alternative embodiments, the strap fastener 36 may simply be a set of screws, bolts, or rivets that secure the flexible strap 30 to the base 10 (at the proximal end).

The flexible strap width 30W is approximately the size of a typical belt such that it may be threaded through the belt loop of most holsters. Alternatively, a holster may be clipped to flexible strap 30. Flexible strap 30 may be injection molded or compression molded and made from rubber, silicone, ethylene propylene diene terpolymer (e.g., EPDM), stretchable fabric, bungee cord, leather, nylon, or another flexible material so as to be durable in harsh environments and remain flexible in cold environments.

Flexible strap 30 is under tension when it is threaded through strap fastener 14, threaded through a holster, and hooked to base clip 12. For example, the flexible strap 30 may be configured such that the tension in the flexible strap 30 maintains the flexible strap 30 taut when threaded through and supporting weight such as a holster carrying a firearm or camera weighing greater than one pound. The flexible strap 30 is also taut when simply stretched between the strap fastener 14 and base clip 12. Flexible strap 30 may extend past the strap eyelet 32 to provide a grip for a user to quickly hook or unhook flexible strap 30 from clip 12. When flexible strap 30 is fastened at both ends to base 10 and threaded through a holster, the tension in flexible strap 30 securely attaches the holster to the base 10 but still allows flexible strap 30 to be easily unhooked from clip 12 for quick removal of a holster when the backpack is taken off and the holster is attached to a normal belt. In embodiments, flexible strap 30 includes a strap grip 34 which may be a set of raised bumps or strips on the distal end of flexible strap 30.

Figure 3C:
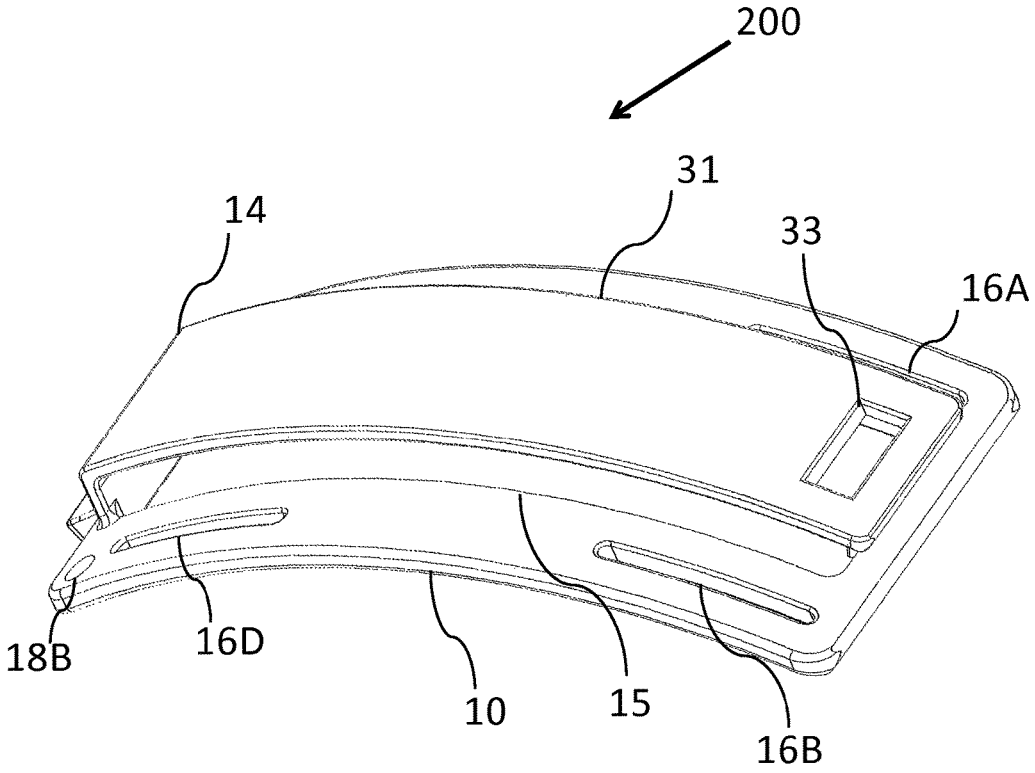
FIG. 3C illustrates another holster strap 200 with a rigid strap 31.

Referring now to FIG. 3C, another embodiment of a holster strap is illustrated as holster strap 200. Holster strap 200 includes many of the same features as holster strap 100 and may be used for various types of holsters, including a clip-type holster. For example, holster strap 200 includes a base 10, a strap fastener 14, a base center notch 15, base fastener notches 16A-D, and base cover holes 18A-B. Holster strap 200 may also have similar dimensions, e.g., a similar radius of curvature, length, and width, as holster strap 100, although holster strap 100 may also be shorter in length to accommodate only smaller holsters.

Holster strap 200 is different from holster strap 100 in that holster strap 200 includes a rigid strap 31 instead of a flexible strap 30. Rigid strap 31 may hinge on strap fastener 14 and clip, via rigid strap notch 33, to base clip 12. Base clip 12 is not shown in FIG. 3C as its view is obscured by rigid strap 31. Rigid strap 31 rotates on strap fastener 14 such that a wearer may secure or release rigid strap 31 from base clip 12 to allow for a slide-on type holster. Alternatively, rigid strap 31 may be permanently secured at both ends of base 10, but be raised off the front surface 10F of base 10, to allow only the installation of a clip-type holster.

Rigid strap 31 may be made of the same material and may be manufactured in the same manner as base 10. For example, base 10 and rigid strap 31 may be injection molded, 3d-printed, or machined.

FIGS. 6 and 7 illustrate the holster strap 100 securing a holster 120 to a backpack waist belt 130. Holster 120 is a slip-on holster that may be used to carry a firearm. In FIGS. 6 and 7, holster strap 100 is secured to a padded backpack waist belt 130 via base retaining straps 19A-B that are threaded through base fastener notches 16A-D and behind padded backpack waist belt 130 (e.g. between the padded backpack waist belt and the wearer's hip). Holster strap 100 is also secured radially around the backpack waist belt 130 with base positioner strap 20. Base positioner strap 20 is secured to holster strap 100 by being threaded through base retaining notch 36 and secured on its other end to a portion of the backpack 140 or backpack frame 140. In these Figures, base positioner strap 20 radially secures base 10 proximal a side of a backpack, or on the wearer's hip.

Figure 8:
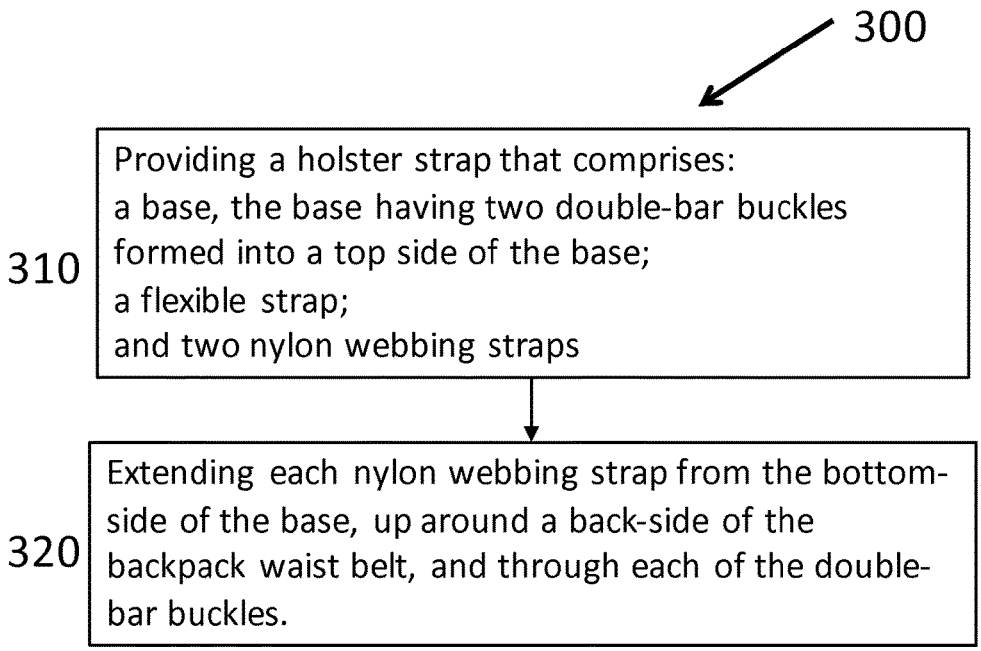
FIG. 8 illustrates a method for securing a holster to the waist belt of a backpack and FIG. 9 illustrates additional alternative steps for the method illustrated in FIG. 8.

FIG. 8 illustrates a method 300 of securing a holster strap 100 to a backpack waist belt 130. The method 300 may include the steps of 310 providing a holster strap 100, the holster strap comprising a base, the base having two double-bar buckles formed into a top side of the base; a flexible strap; and two nylon webbing straps. The method 300 may further include the step of 320 extending each nylon-webbing strap from the bottom-side of the base, up around a back-side of the backpack waist belt, and through each of the double-bar buckles.

Figure 9:
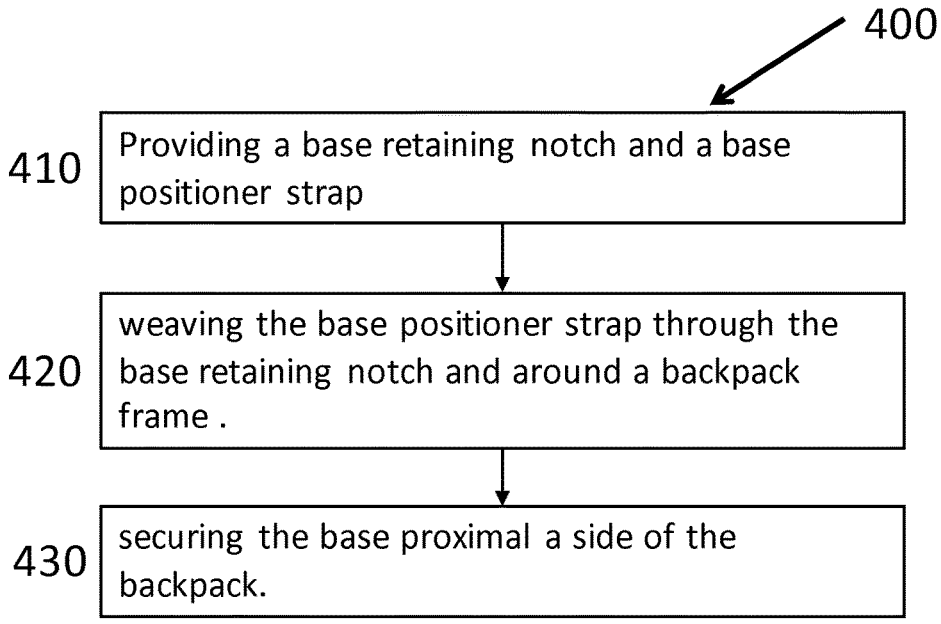

FIG. 9 illustrates some additional optional steps of securing a holster strap 100 to a backpack waist belt 130. The steps may include 410 providing a base retaining notch and a base positioner strap, 420 weaving the base positioner strap through the base-retaining notch and around a backpack frame, and 430 securing the base proximal a side of the backpack.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A holster strap comprising:

a base comprising: a base proximal end, a base distal end, and a radius of curvature; a base strap fastener mechanically coupled to the base proximal end; a base clip mechanically coupled to the base distal end; and a stretchable strap comprising: a strap proximal end and a strap distal end; a strap retainer positioned at the strap proximal end; and one or more strap eyelets positioned within the stretchable strap at the strap distal end; wherein: the strap retainer is secured through a slot in the base strap fastener; the stretchable strap is configured to stretch and maintain a longitudinal tension in the stretchable strap when the base clip is threaded through the strap eyelet and the strap retainer is secured in the base strap fastener; and the base is configured to maintain the radius of curvature when the stretchable strap is stretched between the base strap fastener and the base clip.

2. The holster strap of claim 1, further comprising:

one or more base fastener notches formed integrally into the base; and one or more base retaining straps;

wherein the one or more base retaining straps are configured to weave through the one or more base fastener notches and secure the base to a padded backpack waist belt.

3. The holster strap of claim 2, wherein the holster strap is symmetrical along a length from the proximal end to the distal end of the base; and the base is configured to attach proximal either a left or right-side hip of a person.

4. The holster strap of claim 1, further comprising:

a base retaining notch; and a base positioner strap;

wherein the base positioner strap is configured to weave through the base retaining notch and connect to the back of a backpack such that the base is radially secured proximal a side of the backpack and prevented from moving along a padded waist belt of the backpack.

5. The holster strap of claim 1, wherein a distance along a length of the base length from the strap fastener and the base clip is greater than two (2) inches and less than ten (10) inches.

6. The holster strap of claim 1, further comprising:

two double-bar buckles formed integrally into a top side of the base;

two slots formed integrally into a bottom side of the base, the top side and bottom side defining a base width; and two straps, each strap threaded through one of the slots and forming a loop through one of the slots and the bottom-side of the base and extending up and being secured by one of the double-bar buckles.

7. The holster strap of claim 1, wherein the strap is configured such that the longitudinal tension in the strap is sufficient to maintain the strap taut when threaded through and supporting weight greater than one pound.

8. The holster strap of claim 1, wherein the base has a radius of curvature matching a waist size from between 28 inches and 48 inches.

9. A method of securing a holster to a backpack waist belt comprising: providing a holster strap, the holster strap comprising: a base comprising: a base proximal end and a base distal end; a base strap fastener mechanically coupled to the base proximal end; a base clip mechanically coupled to the base distal end two double-bar buckles formed integrally into a top side of the base two slots formed integrally into a bottom side of the base, the top side and bottom side of the base defining a base width; a stretchable strap comprising: a strap proximal end and a strap distal end; a strap retainer positioned at the strap proximal end; and one or more strap eyelets positioned within the stretchable strap at the strap distal end; wherein: the base has a radius of curvature matching a waist size from between 28 inches and 48 inches; the strap retainer is secured through a slot in the base strap fastener; the stretchable strap is configured to stretch and maintain a longitudinal tension in the stretchable strap with the base clip threaded through the strap eyelet; and the base is configured to maintain the radius of curvature when the stretchable strap is stretched between the base strap fastener and the base clip; and threading two nylon webbing straps from the bottom-side of the base, up around a back-side of the backpack waist belt, and through each of the two, respective double-bar buckles.

10. The method of claim 9, further comprising:

providing:

a base retaining notch formed in the base; and a base positioner strap; and weaving the base positioner strap through the base retaining notch and around a backpack frame; and securing the base proximal a side of the backpack with the base positioner strap.

* * * * *